United States Patent [19]

Batakis et al.

[11] Patent Number: 5,031,399

[45] Date of Patent: Jul. 16, 1991

[54] TURBINE INCLUDING A THERMAL GROWTH ACCOMMODATING MOUNT FOR A VANE ASSEMBLY

[75] Inventors: Anthony Batakis; Jack R. Shekleton, both of San Diego, Calif.

[73] Assignee: Sundstrand Corporation, Rockford, Ill.

[21] Appl. No.: 383,754

[22] Filed: Jul. 24, 1989

[51] Int. Cl.[5] ..... F02C 3/06

[52] U.S. Cl. ..... 60/39.320; 60/39.360; 60/760

[58] Field of Search ..... 60/39.36, 760, 748, 60/758, 39.32

[56] References Cited

U.S. PATENT DOCUMENTS

| | | | |
|---|---|---|---|
| 2,916,878 | 12/1959 | Wirt | 60/759 |
| 2,924,937 | 2/1960 | Leibach | 60/39.36 |
| 3,613,360 | 10/1971 | Howes | 60/755 |
| 3,797,236 | 3/1974 | Hooke et al. | 60/39.31 |
| 4,151,709 | 5/1979 | Melconian et al. | 60/39.36 |
| 4,794,754 | 1/1989 | Shekleton et al. | 60/760 |
| 4,825,640 | 2/1989 | Shekleton | 60/39.36 |

*Primary Examiner*—Louis J. Casaregola
*Assistant Examiner*—Timothy S. Thorpe
*Attorney, Agent, or Firm*—Wood, Phillips, Mason, Recktenwald & Vansanten

[57] ABSTRACT

Unequal flow rates of dilution air about an annular combustor and the resulting hot spots and thermal stresses are avoided in a structure wherein a vane assembly (66) made up of ring (76) and integral vanes (76) is mounted to the rear turbine shroud (42) for limited movement with respect thereto sufficient to accommodate unequal thermal growth of the rear turbine shroud (42) and the vane assembly (66).

8 Claims, 2 Drawing Sheets

11
64
30
24
22
26
20
56
54
38
32
28
58
52
40
66
36
60
18
50
34
16
42
44
14
12
10

76
90
76
90
76
90

TURBINE INCLUDING A THERMAL GROWTH ACCOMMODATING MOUNT FOR A VANE ASSEMBLY

FIELD OF THE INVENTION

This invention relates to gas turbines, and more particularly, to the mounting of a vane assembly to a turbine wheel shroud such that unequal rates of thermal growth may be accommodated.

BACKGROUND OF THE INVENTION

In the commonly assigned application of Shekleton et al, filed Dec. 28, 1988, entitled Gas Turbine Annular Combustor with Radial Dilution Air Injection, Ser. No. 291,041 and assigned to the same assignee as the instant application, the details of which are herein incorporated by reference, there is disclosed a gas turbine construction wherein the vast majority of dilution air is passed completely around an annular combustor to cool the same and to impinge upon a turbine wheel shroud to likewise provide cooling. The dilution air is then injected into the combustor outlet just upstream of the turbine nozzle to mix with the gases of combustion before contacting the nozzle. An extremely compact assembly results. Moreover, the assembly is capable of relatively high power densities without accelerated failure rates because of the excellent cooling of the turbine shroud that is obtained which in turn reduces thermal stresses in the apparatus.

Nonetheless, further improvement is desired so as to achieve the maximum utility of the system. In particular, for maximum utility, such a system must have uniform airflow about the combustor. Typically, the airflow will be from the turbine compressor about the radially outer side of the annular combustor and then about a radial wall of the combustor opposite from the combustor outlet and finally, about the radially inner wall of the combustor whereat the dilution air further impacts against the turbine shroud. If this airflow is not uniform, hot spots may develop. Hot spots are, of course, to be avoided because the resulting thermal gradients induce thermal stresses due to the temperature differences.

In a system of the type mentioned, it is extremely important that uniform airflow be present in the area adjacent the turbine shroud and where the dilution air stream is combined with the gases of combustion just upstream of the nozzle. Not infrequently, vanes will be employed in this area to direct the flow of the dilution area in a given path and if flow through the vanes is not uniform, hot spots will result. These in turn will result in distortions that may further change the shape of the passage for the airflow, which in turn increases the nonuniformity of airflow, which leads to greater distortions, etc.

The present invention is directed to overcoming one of more of the above problems.

SUMMARY OF THE INVENTION

The principal object of the invention is to provide a new and improved gas turbine. More specifically, it is an object of the invention to provide, in a gas turbine, a new and improved means for mounting a vane structure in a dilution air path so as to achieve uniform flow of dilution air and thereby avoid the difficulties associated with non-uniform flow.

An exemplary embodiment of the invention achieves the foregoing object in a gas turbine structure including a turbine wheel mounted for rotation about an axis and with a shroud about the turbine wheel. An annular combustor is disposed about the shroud and is spaced therefrom to define a cooling air passage. The combustor discharges gas towards the turbine wheel for driving the same. According to the invention, a vane assembly is located in the cooling air passage and is mounted on the shroud for limited movement relative thereto to allow unequal thermal growth between the shroud and the vane assembly.

As a consequence of this construction, distortions as a result of unequal thermal growth are eliminated so that uniform flow passage size may be achieved to minimize or eliminate the formation of hot spots.

In a preferred embodiment, a cooling air port is at the end of the cooling air passage and is defined by the space between the shroud and the combustor just upstream of a nozzle utilized to direct gases at the turbine. The invention provides a vane assembly in the port which in turn has vanes extending generally axially across the port into substantial abutment with the combustor.

According to this embodiment of the invention a mounting ring is located on the shroud and defines a radially directed, annular vane assembly receiving groove. A vane assembly is located in the groove and only partially fills the same so that relative movement between the vane assembly and the shroud may occur to relieve thermal stresses.

In a highly preferred embodiment of the invention, the shroud includes an annular, shallow groove having a planar bottom opposite of the turbine wheel and facing the port. The groove has a width of sufficient size so as to loosely receive the vane assembly and allow unequal thermal growth of the shroud and the vane assembly.

Preferably, a retaining ring is mounted on the shroud and partially overlies the groove to capture the vane assembly therein.

In a preferred embodiment, the vane assembly is made up of a ring mounting a plurality of vanes.

In a highly preferred embodiment, the ring and the vanes are internally formed of a single piece of material According to the invention, the vanes may be defined by a series of spaced grooves machined in a side of the ring.

According to one embodiment of the invention, the vanes extend across the port to contact with the combustor. Typically, they will be butt fused to the combustor as by brazing.

According to another embodiment of the invention, the combustor, adjacent the port, includes vane receiving openings and the vanes are located within the openings and are fused to the combustor within such openings.

Other objects and advantages will become apparent from the following specification taken in connection with the accompanying drawings.

DESCRIPTION OF THE PREFERRED EMBODIMENTS

Figure 1:
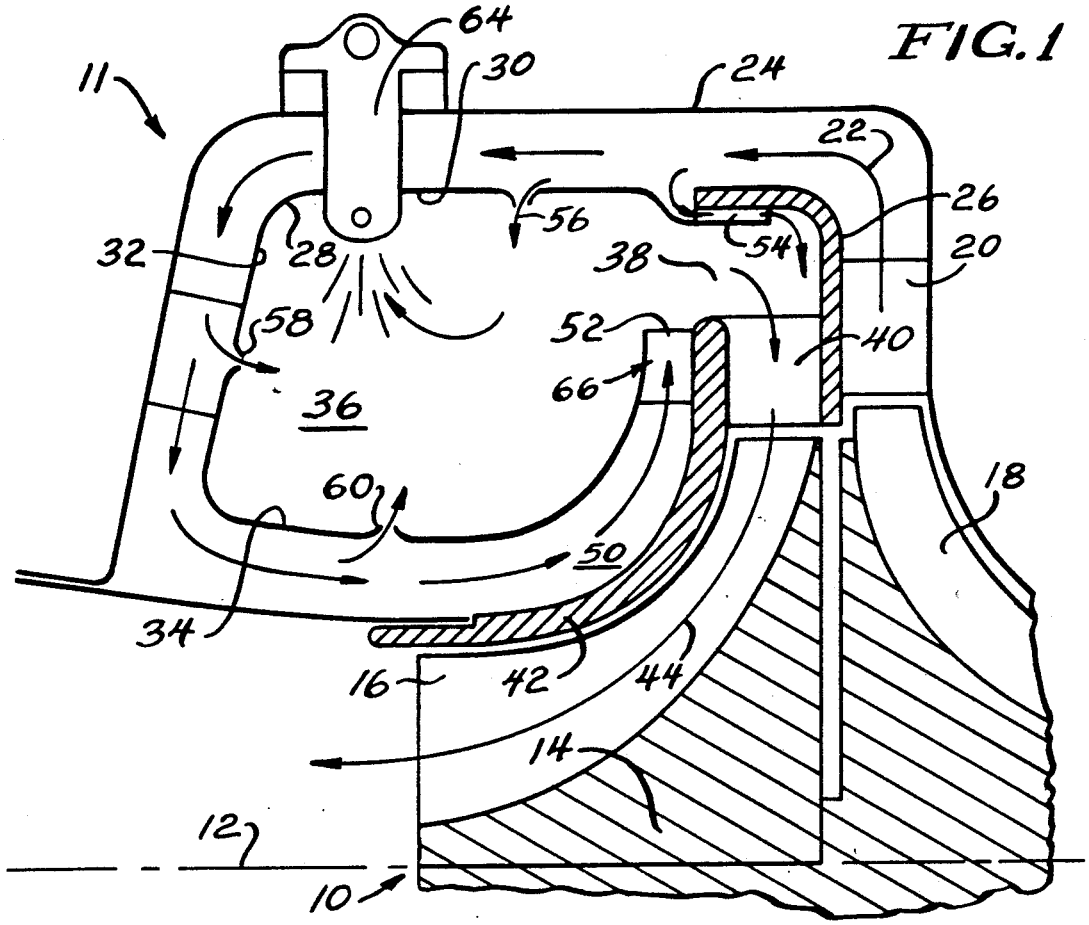
FIG. 1 is a somewhat schematic, fragmentary, sectional view of the turbine made according to the invention.

An exemplary embodiment of the gas turbine engine employing the invention is illustrated in FIG. 1 and with reference thereto is seen to include a rotor, generally designated 10, mounted by any suitable means (not shown) for rotation about an axis 12. As is well known, the rotor includes a hub 14. On one side of the hub 14, there may be provided vanes or blades 16 against which hot gases of combustion may be directed to rotate the rotor 10 about the axis 12. Thus, that section of the hub 14 with the blades 16 defines a turbine wheel.

Oppositely of the blades 16, the hub 14 may include compressor vanes 18 if desired. Alternatively, a separate hub may be utilized to define the compressor. For that matter, the compressor defining hub need even not be mounted for rotation about the axis 12 but may rotate about another axis.

In any event, compressed air from the compressor blades 18 is passed through a diffuser 20 as illustrated by arrows 22. From the diffuser 22 the air passes into a housing 24 that is in surrounding relationship to the rotor 10 as well as a so called front shroud 26 for the turbine wheel defined go the hub 14 and the blades 16. Contained within the housing 24 is a so-called annular combustor 28 having a radially outer wall 30, a generally radial wall 32, and a radially inner wall 34. Within the walls, 30, 32, 34, a somewhat annular or ringlike combustion space 36 is defined. The space 36 includes an outlet area 38 immediately upstream of a plurality of vanes or blades 40 located between the front shroud 26 and a rear shroud 42 to define a nozzle to direct the gases of combustion in the direction of an arrow 44 against the blades 16 to drive the rotor 10. As is well known, the rear shroud 42 extends from the nozzle 40 along the periphery of the blades 16 to the end of the rotor 10 to contain the gases of combustion against the blades 16.

As can be seen, the spacing of the walls, 30, 32 from the housing 24 provides a cooling air plenum about the annular combustor 28. This cooling air plenum is continued in the vicinity of the rear shroud 42 and is designated 50. The plenum terminates in an annular port 52 just upstream of the outlet 38 from the combustor 28 to the nozzle vanes 40. Various inlets such as shown at 54, 56, 58 and 60 are provided to allow a certain amount of dilution or cooling air to exit the plenum and enter the combustor for cooling purposes. However, the same are sized so that the vast majority of cooling air passes entirely about the combustor 28 to enter the combustor at the port 52 as more fully disclosed in the previously-identified application of Shekleton et al.

One or more fuel injectors 64 are mounted on the housing 24 and extend into the combustor space 36. The same may inject fuel tangentially to allow fabrication of a relatively short (in the axial direction) annular combustor 28. Typically, there will be considerable circumferential swirl of the gases as a result and it will be desirable that the dilution air entering the combustor at the port 52 be swirling in the same direction. Consequentially, if a vane assembly, generally designated 66, is disposed within the port to provide for such swirling action and to assure uniformity of flow at the port.

Figure 3:
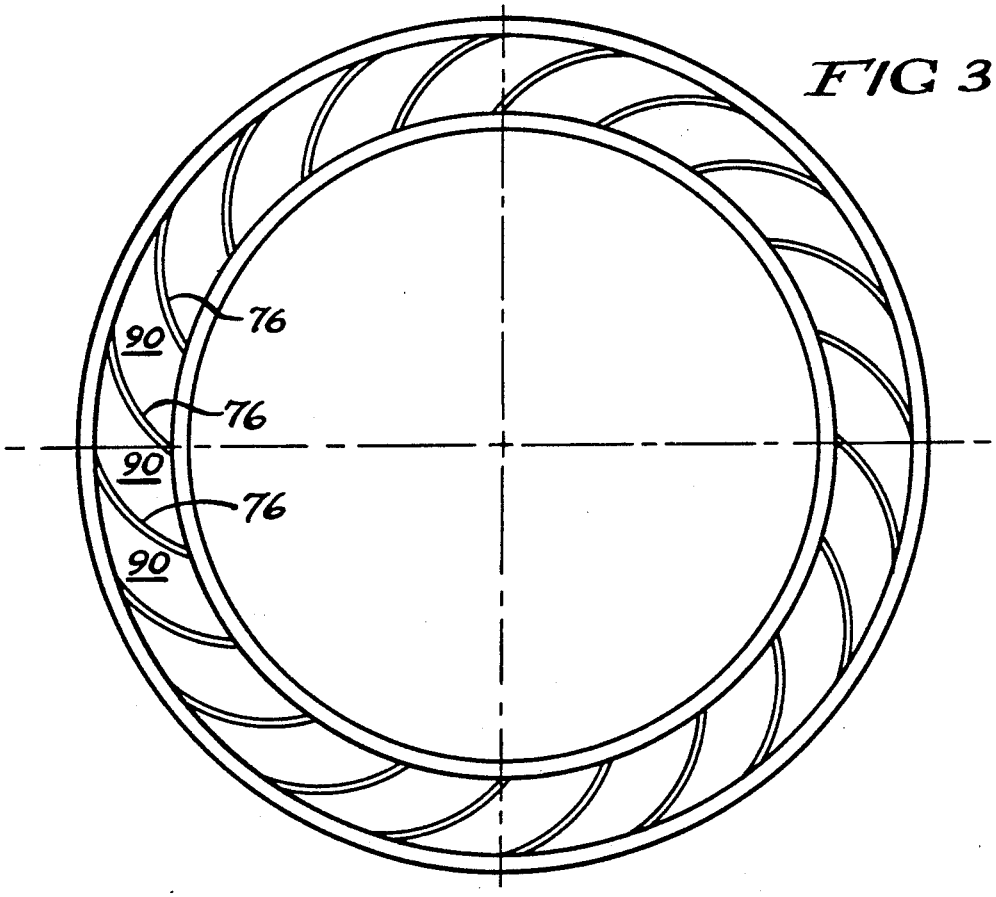
FIG. 3 is a side elevation of a vane assembly.
Figure 2:
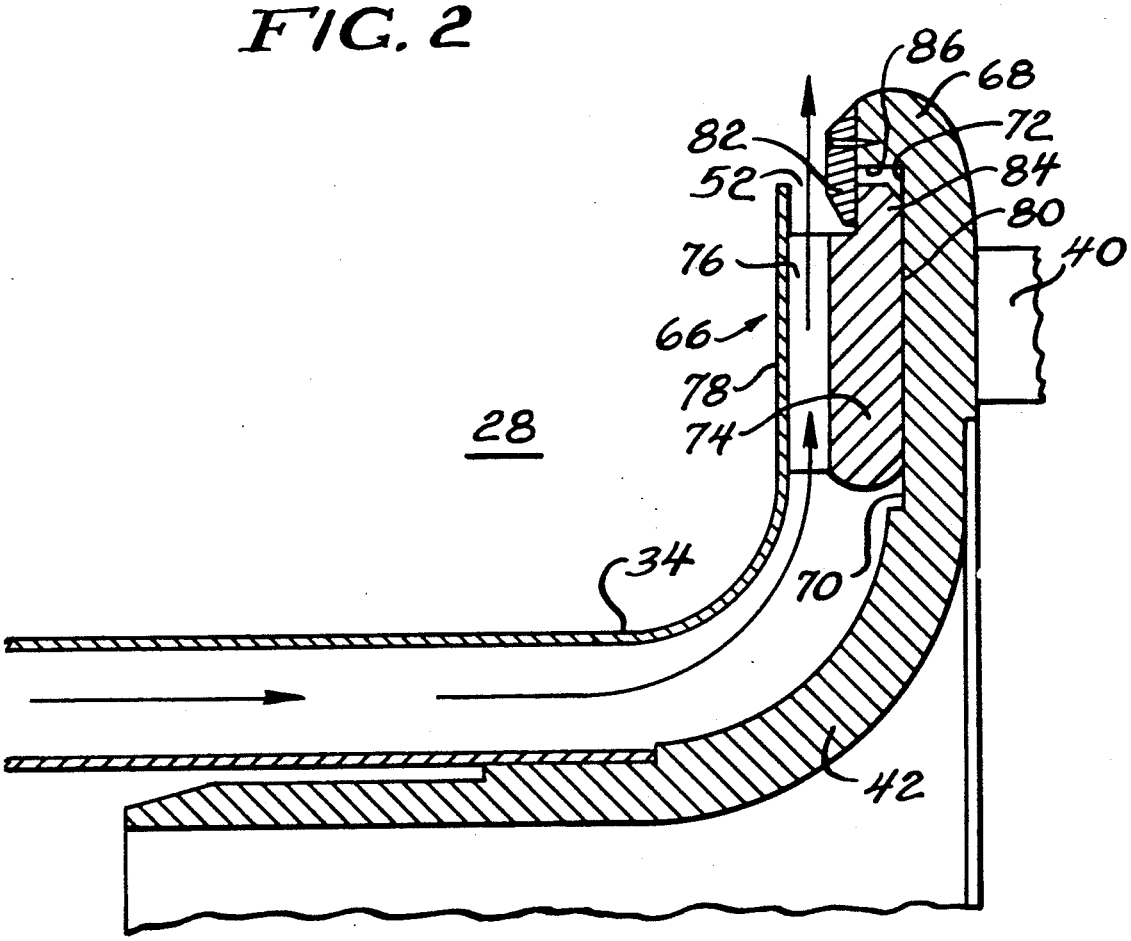
FIG. 2 is an enlarged, fragmentary view of a vane assembly and the mounting therefore made according to the invention.

Turning now to FIGS. 2 and 3, near its radially outer terminus 68, the rear shroud 42 includes a shallow, peripheral groove 70 having a planar bottom 72 that faces away from the nozzle vanes 40 and toward the annular combustor 28. Disposed within the groove 70 is a ring 74 which mounts a plurality of axially extending vanes 76. The vanes 76 extend away from the rear shroud 42 toward the combustor 28 and abut the same period. Preferably, the ends 78 of the vanes 76 are butt brazed to the combustor at this location.

It will observed that the width of the groove 70 is greater than the width or thickness of the ring 74. It will also be observed that the ring 74 includes a planar surface 80 that is in abutment with the planar bottom 72 of the groove 70. As a consequence of this construction, the ring 74 may slide slightly within the groove 70 as a result of unequal thermal growth of the shroud 42 and the ring 74.

To captivate the ring 74 within the groove 70 a retaining or mounting ring 82 is secured to the end 68 of the shroud 42 to partially overlay the radially outer extremity in abutting relation to a peripheral lip 84 that is directed radially outwardly and is on the ring 74.

It will be noted that this construction defines a radially directed groove 86, here radially inwardly opening. The groove 86 is partially occupied by the ring 74 but not fully occupied or filled thereby so as to allow the aforementioned differential thermal growth of the various components.

As can be seen in FIG. 3, the vanes 76 are arcuate in configuration Preferably, they are formed by machining rather wide but relatively shallow grooves 90 in the side of the ring opposite the surface 80. Thus, the vane assembly in a preferred embodiment includes the vanes 78 that are integral with the ring 74, being formed a single piece of material.

Figure 4:
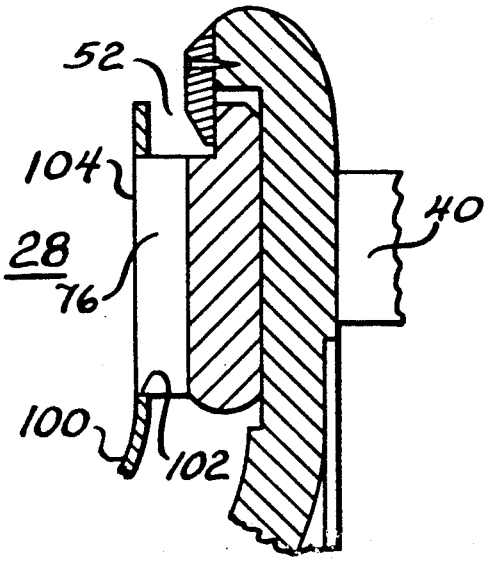
FIG. 4 is a view somewhat like FIG. 2 but showing a modified embodiment of the invention.

A modified embodiment of the invention is illustrated in FIG. 4. According to this embodiment of the invention, a wall 100 of the combustor 28 is provided with a series of openings 102 sized and shaped and aligned with the ends 104 of the the vanes 76. As a consequence, the ends 104 of the vane 76 may be introduced into the openings 102 and may be inset fused thereto as, for example, by brazing. This embodiment of the invention produces a stronger bond between the vane 76 and the combustor 28 but is somewhat more complicated to form.

From the foregoing, it will be appreciated that the vane assembly of the invention is ideally mounted in such a way that variations or differences in thermal growth between the rear shroud 42 and vane assembly 66 are readily accommodated. Moreover, because the vane assembly 66 is mounted to the shroud rear 42 and bonded to the combustor 28, which is thinner than the rear shroud 42 the latter relatively easily follows the former upon thermal growth such that the size of the dilution air passages between the vanes 76 does not change during operation of the turbine and thereby prevents the formation of hot spots. This in turn assures a minimum of thermal stress and promotes long life of the turbine engine

We claim:

1. A gas turbine comprising:

a rotor including a turbine wheel journaled for rotation about an axis;

an annular nozzle radially outward of an surrounding said turbine wheel for directing gases inwardly at said turbine wheel;

an annular shroud extending from said nozzle about the periphery of said turbine wheel to contain gases from said nozzle against said turbine wheel;

an annular combustor about said axis and having an outlet connected to said nozzle;

a cooling air plenum for directing cooling air about the combustor and including an annular section between said shroud and said combustor, said annular section terminating in an annular port in said combustor upstream of said outlet;

a ring in said port and abutting said shroud oppositely of said turbine wheel;

means for mounting said ring on said shroud for limited movement relative to said shroud in response to thermal stresses; and a plurality of vanes on said ring and extending across said port into substantial abutment with said combustor.

2. The turbine of claim 1 wherein said ring and aid vanes are integrally formed of a single piece of material.

3. The turbine of claim 2 wherein said vanes are defined by a series of spaced grooves in a side of said ring.

4. The turbine of claim 1 wherein said vanes contact said combustor.

5. The turbine of claim 1 wherein said combustor, adjacent said port, includes vane receiving openings, said vanes being located within said openings and fused to said combustor.

6. A gas turbine comprising:

a rotor including a turbine wheel journaled for rotation about an axis;

an annular nozzle radially outward of an surrounding said turbine wheel for directing gases inwardly at said turbine wheel;

an annular shroud extending from said nozzle about the periphery of said turbine wheel to contain gases from said nozzle against said turbine wheel;

an annular combustion about said axis and having an outer connected to said nozzle;

a cooling air plenum for directing cooling air about the combustor and including an annular section between said shroud and said combustor, said annular section terminating in an annular port in said combustor upstream of said outlet;

a vane assembly in said port, mounted on said shroud and having a space vanes extending generally axially across said port into substantial abutment with said combustor; and a mounting ring on said shroud and defining a radially directed, annular vane assembly receiving groove;

said vane assembly being located in said groove and only partially filling the same so that relative movement between said vane assembly and said shroud may occur to relieve thermal stresses.

7. A gas turbine comprising:

a rotor including a turbine wheel journaled for rotation about an axis;

an annular nozzle radially outward of sand surrounding said turbine wheel for directing gases inwardly iat said turbine wheel;

an annular shroud extending from said nozzle about the periphery of said turbine wheel to contain gases from said nozzle against said turbine wheel;

an annular combustion about said axis and having an outer connected to said nozzle;

a cooling air plenum for directing cooling air about the combustor and including an annular section between said shroud and said combustor, said annular section terminating in an annular port in said combustor upstream of said outlet; and a vane assembly in aid port, mounted on said shroud and having spaced vanes extending generally axially across said port into substantial abutment with said combustor;

said shroud including an annular, shallow groove having a planar bottom opposite of said turbine wheel and facing said port, said groove having a width of sufficient size as to receive said vane assembly and allow unequal thermal growth of the shroud and the vane assembly.

8. The turbine of claim 7 further including a retaining ring mounted on said shroud and partially overlying said groove.

* * * * *